US011572758B2

(12) United States Patent
Hallundbæk et al.

(10) Patent No.: US 11,572,758 B2
(45) Date of Patent: Feb. 7, 2023

(54) ANNULAR BARRIER WITH PRESSURE-INTENSIFYING UNIT

(71) Applicant: Welltec Oilfield Solutions AG, Zug (CH)

(72) Inventors: Jørgen Hallundbæk, Zug (CH); Satish Kumar, Zug (CH)

(73) Assignee: Welltec Oilfield Solutions AG, Zug (CH)

( * ) Notice: Subject to any disclaimer, the term of this patent is extended or adjusted under 35 U.S.C. 154(b) by 0 days.

(21) Appl. No.: 17/488,892

(22) Filed: Sep. 29, 2021

(65) Prior Publication Data

US 2022/0098954 A1 Mar. 31, 2022

(30) Foreign Application Priority Data

Sep. 30, 2020 (EP) ..... 20199212
Oct. 5, 2020 (EP) ..... 20200097

(51) Int. Cl.
*E21B 33/12* (2006.01)
*E21B 34/06* (2006.01)

(52) U.S. Cl.
CPC ..... *E21B 33/1208* (2013.01); *E21B 34/06* (2013.01)

(58) Field of Classification Search
CPC ..... E21B 33/1208; E21B 34/06; E21B 33/12; E21B 33/127; E21B 34/103; E21B 33/1212
See application file for complete search history.

(56) References Cited

U.S. PATENT DOCUMENTS

| | | | | |
|---|---|---|---|---|
| 9,708,862 | B2 * | 7/2017 | Hallundbæk | E21B 17/00 |
| 9,725,980 | B2 * | 8/2017 | Hallundbæk | E21B 33/127 |
| 10,519,741 | B2 * | 12/2019 | Vasques | E21B 33/13 |
| 10,605,039 | B2 * | 3/2020 | Vasques | E21B 47/06 |
| 10,669,811 | B2 * | 6/2020 | Tanguy | E21B 33/127 |

(Continued)

FOREIGN PATENT DOCUMENTS

| | | |
|---|---|---|
| EP | 1 138 872 | 10/2001 |
| EP | 2 565 368 | 3/2013 |

(Continued)

OTHER PUBLICATIONS

Extended EP Search Report for EP20199212.0 dated Mar. 2, 2021, 8 pages.

*Primary Examiner* — Steven A MacDonald
(74) *Attorney, Agent, or Firm* — Nixon & Vanderhye P.C.

(57) ABSTRACT

The present invention relates to an annular barrier to be expanded in an annulus between a well tubular metal structure and an inside wall of a borehole downhole for providing zone isolation between a first zone and a second zone of the borehole, comprising a tubular metal part for mounting as part of the well tubular metal structure, an expandable metal sleeve surrounding the tubular metal part, each end of the expandable metal sleeve being connected with the tubular metal part, an expandable space between the expandable metal sleeve and the tubular metal part, and an expansion opening in the tubular metal part through which fluid enters in order to expand the expandable metal sleeve, wherein the annular barrier further comprises a pressure-intensifying unit. The invention also relates to a downhole system comprising a well tubular metal structure and an annular barrier.

15 Claims, 12 Drawing Sheets

(56) References Cited

U.S. PATENT DOCUMENTS

Figure 1:
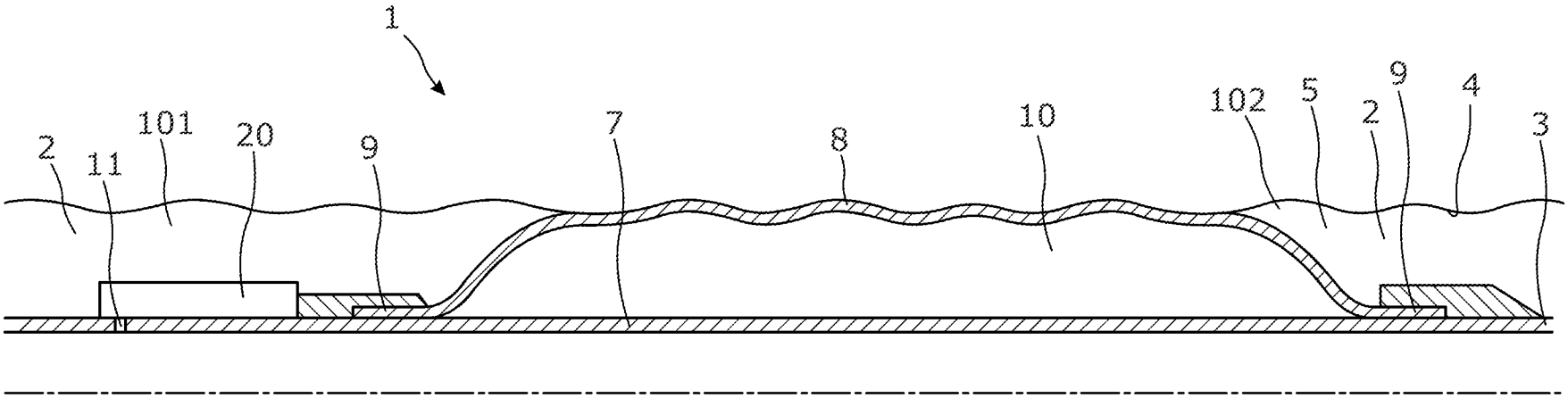

| | | | | |
|---|---|---|---|---|
| 10,947,810 | B2 * | 3/2021 | Vasques | E21B 33/1243 |
| 2005/0011678 | A1 * | 1/2005 | Akinlade | E21B 33/1243<br>166/279 |
| 2014/0190708 | A1 * | 7/2014 | Hallundbaek | E21B 33/1277<br>166/207 |
| 2014/0216755 | A1 * | 8/2014 | Hallundbæk | E21B 33/1243<br>166/387 |
| 2020/0248530 | A1 * | 8/2020 | Kumar | E21B 34/10 |

FOREIGN PATENT DOCUMENTS

| | | |
|---|---|---|
| EP | 2 570 588 | 3/2013 |
| EP | 3 327 246 | 5/2018 |

* cited by examiner

ANNULAR BARRIER WITH PRESSURE-INTENSIFYING UNIT

This application claims priority to EP Patent Application No. 20199212.0 filed Sep. 30, 2020 and EP Patent Application No. 20200097.2 filed Oct. 5, 2020, the entire contents of each of which are hereby incorporated by reference.

The present invention relates to an annular barrier to be expanded in an annulus between a well tubular metal structure and an inside wall of a borehole downhole for providing zone isolation between a first zone and a second zone of the borehole. The invention also relates to a downhole system comprising a well tubular metal structure and an annular barrier.

In wellbores, annular barriers are used for different purposes, such as for providing an isolation barrier. An annular barrier has a tubular part mounted as part of the well tubular structure, such as the production casing, which is surrounded by an annular expandable sleeve. The expandable sleeve is typically made of metal and fastened at its ends to the tubular part of the annular barrier.

The pressure envelope of a well is governed by the burst rating of the well tubular metal structure, e.g. the production casing, and the well hardware, e.g. other completion components, used within the well construction. In some circumstances, the expandable sleeve of an annular barrier may be expanded by increasing the pressure within the well, which is the most cost-efficient way of expanding the sleeve and setting such metal packer. The pressure rating of a well defines the maximum pressure that can be applied in the well for expanding the sleeve without damaging other components of that well, and it is desirable to minimise the expansion pressure required for expanding the sleeve in order to minimise the exposure of the well to the expansion pressure since many wells have a lower pressure rating than required to expand an expandable metal sleeve of an annular barrier.

When expanded, annular barriers may be subjected to a continuous pressure or a periodic high pressure from the outside, either in the form of hydraulic pressure within the well environment or in the form of formation pressure. In some circumstances, such pressure may cause the annular barrier to collapse, which may have severe consequences for the area which is to be sealed off by the barrier as the sealing properties are lost due to the collapse.

Current requirements for collapse ratings of annular barriers have led to the use of increasingly higher expansion pressures as the expandable metal sleeve has to be made thicker. However, not only the pressure rating of the completion is affected by increasing expansion pressures; a variety of downhole tools may also become ineffective or stop functioning under high pressure. Therefore, some wells have a low pressure rating, i.e. the allowed expansion pressure used in the well, in order to protect the tools and equipment present in the well from being damaged. The problem may be circumvented by decreasing the thickness or strength of the expandable sleeve. However, this impairs the collapse rating.

It is an object of the present invention to wholly or partly overcome the above disadvantages and drawbacks of the prior art. More specifically, it is an object to provide an annular barrier being expandable without damaging other components in the completion and without reducing the collapse rating of the annular barrier.

The above objects, together with numerous other objects, advantages and features, which will become evident from the below description, are accomplished by a solution in accordance with the present invention by an annular barrier to be expanded in an annulus between a well tubular metal structure and an inside wall of a borehole downhole for providing zone isolation between a first zone and a second zone of the borehole, comprising

- a tubular metal part for mounting as part of the well tubular metal structure,
- an expandable metal sleeve surrounding the tubular metal part, each end of the expandable metal sleeve being connected with the tubular metal part,
- an expandable space between the expandable metal sleeve and the tubular metal part, and
- an expansion opening in the tubular metal part through which fluid enters in order to expand the expandable metal sleeve, wherein the annular barrier further comprises a pressure-intensifying unit having a first bore and a piston unit, the first bore having a first bore part with a first inner diameter and a second bore part with a second inner diameter, the piston unit having a first piston with a first outer diameter corresponding to the first inner diameter and a second piston with a second outer diameter corresponding to the second inner diameter, the second piston being connected to the first piston by means of a connecting rod, which connecting rod has a smaller outer diameter than the second piston, the first outer diameter being smaller than the second outer diameter, the first bore part having a first opening in fluid communication with the expansion opening through a first fluid channel, a first non-return valve being arranged in the first fluid channel, allowing fluid to enter the first opening, the first bore having a second opening fluidly connected with a part of the first fluid channel upstream of the first non-return valve, the first bore part having a third opening in fluid communication with the expandable space through a second non-return valve, the second bore part having a fourth opening for entry of fluid in order to allow the first piston to move in a first direction, ejecting fluid through the third opening and into the expandable space, and for exit of fluid in order to allow the first piston to move in a second direction opposite the first direction, and wherein the second bore part has a fifth opening in fluid communication with the fourth opening through a second fluid channel, and a sequence piston surrounding the connecting rod and having a first sequence position in which the sequence piston prevents fluid communication between the second opening and the fifth opening and a second sequence position in which the sequence piston allows fluid communication between the second opening and the fifth opening in order to move the piston unit in the first direction.

Moreover, the first bore may comprise a sixth opening arranged between the fifth opening and the third opening and in fluid communication with the annulus.

In addition, the sixth opening may be in fluid communication with the annulus through a filtering element.

Furthermore, the second piston may move between the fourth opening and the fifth opening so that fluid flows between the fourth opening and the fifth opening via the second fluid channel.

Also, the sequence piston may have a first piston part and a second piston part and an intermediate piston part connecting the first piston part and the second piston part, the intermediate piston part having a smaller outer diameter than that of the first piston part and the second piston part so as to fluidly connect the second opening and the fifth opening when the sequence piston is in the second sequence position.

Further, the sequence piston may have a first piston part and a second piston part and an intermediate piston part connecting the first piston part and the second piston part, the intermediate piston part having a smaller outer diameter than that of the first piston part and the second piston part, providing an annular cavity between the first bore and the sequence piston to enable fluid passage.

Moreover, the sequence piston may have a through-bore having a bore diameter being larger than the outer diameter of the connecting rod so that fluid is allowed to pass between the connecting rod and the sequence piston.

In addition, the outer diameter of the first piston part and the second piston part of the sequence piston may correspond to the inner diameter of the second bore part.

Furthermore, the second piston part of the sequence piston may be provided with at least two sealing elements arranged at a distance between them that is larger than the diameter of the fifth opening.

Also, the outer diameter of the connecting rod may be smaller than the first outer diameter and the second outer diameter.

Further, the outer diameter of the connecting rod may be smaller than the first outer diameter and substantially equal to the second outer diameter.

Moreover, the first piston may move between the second opening and the third opening.

In addition, the first piston and/or the second piston may have metal seals, ceramic seals or similar seals, and not elastomeric seals or O-rings.

Furthermore, the annular barrier may comprise a second outer diameter being more than 1.5 times larger than the first outer diameter, preferably more than 2 times larger than the first outer diameter, and more preferably more than 2.5 times larger than the first outer diameter.

Also, the pressure-intensifying unit may comprise a second bore having a first aperture fluidly connected with the expansion opening and a second aperture fluidly connected with the first fluid channel, a third piston and a fourth piston connected by means of a second connecting rod being arranged in the second bore, and in a deployment position, the third piston and the fourth piston being arranged on either side of the second aperture, preventing fluid from entering the expandable space.

Further, the second bore may comprise a third aperture in fluid communication with the annulus and a fourth aperture in fluid communication with the expandable space.

Moreover, in the deployment position, the third piston and the fourth piston may both be arranged on one side of the third and fourth apertures, providing fluid communication between the third and fourth apertures.

In addition, a shear pin may be arranged for preventing the third piston and the fourth piston from moving before a predetermined pressure is obtained in the well tubular metal structure, acting on the third piston.

Furthermore, after deployment and shearing of the shear pin, the third piston and the fourth piston may move, providing fluid communication between the first and second apertures.

Also, the pressure-intensifying unit may comprise a first chamber having a first chamber opening fluidly connected to the second bore part for accumulating fluid from the second bore part.

Further, the first chamber may be an accumulating chamber.

Moreover, the first chamber may have a second chamber opening fluidly connected with the first fluid channel, and the first chamber may comprise a first chamber piston being spring-loaded by means of a first spring so that the first chamber piston is forced towards the first chamber opening, the first chamber piston being allowed to move between the first chamber opening and the second chamber opening.

In addition, the pressure-intensifying unit may comprise a second chamber fluidly connected with the second bore part via the first chamber.

Furthermore, the second chamber may comprise a third chamber opening in fluid communication with the first chamber, the second chamber comprising a fourth chamber opening fluidly connected with the annulus, the second chamber comprising a second chamber piston being spring-loaded by means of a second spring so that the second chamber piston is forced towards the fluid connection to the second bore part and forced to move between the third chamber opening and the fourth chamber opening.

Finally, the invention relates to a downhole system comprising a well tubular metal structure and an annular barrier as mentioned above, wherein the tubular metal part is mounted as part of the well tubular metal structure.

Figure 2A:
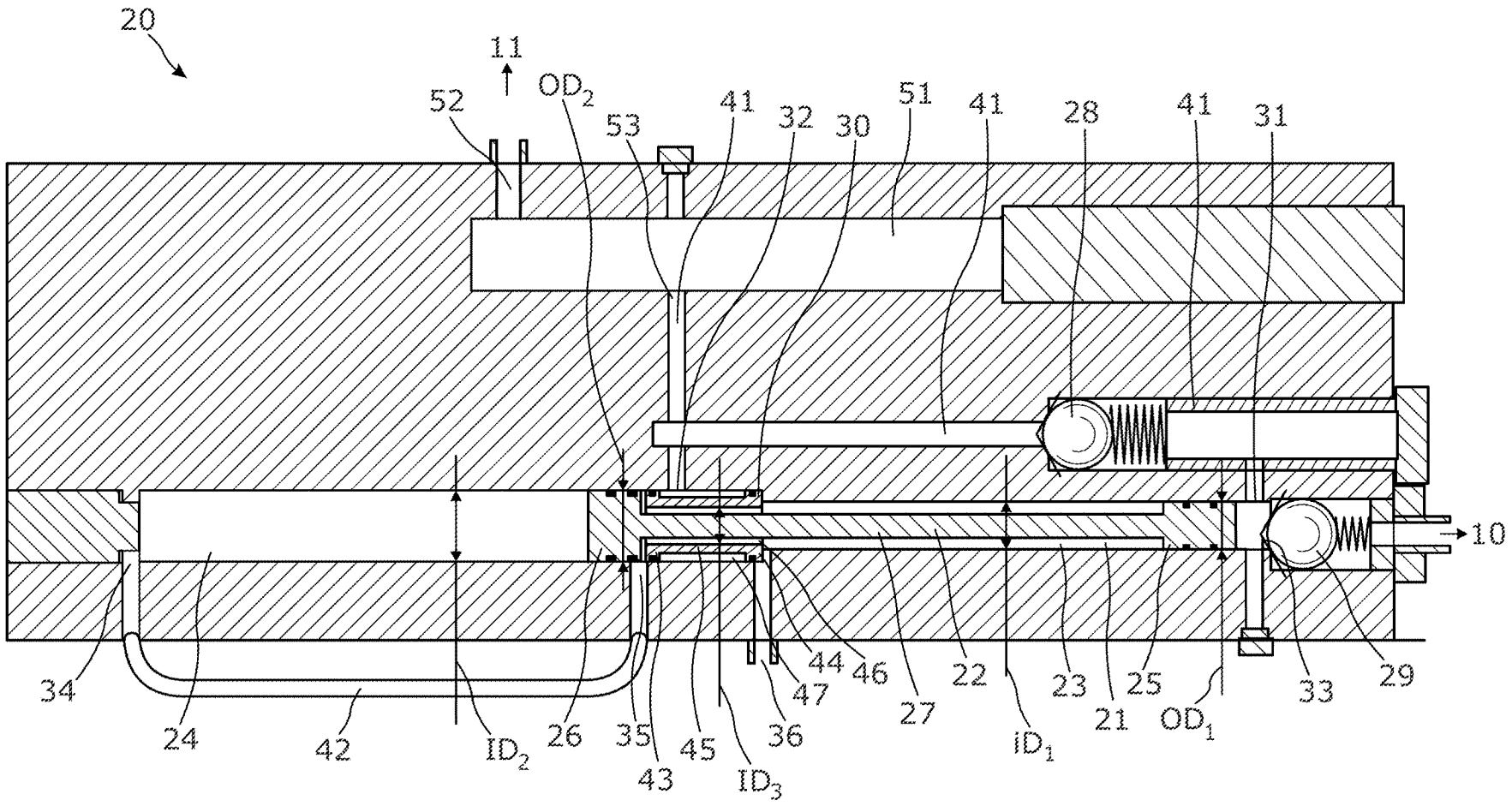
Figure 2B:
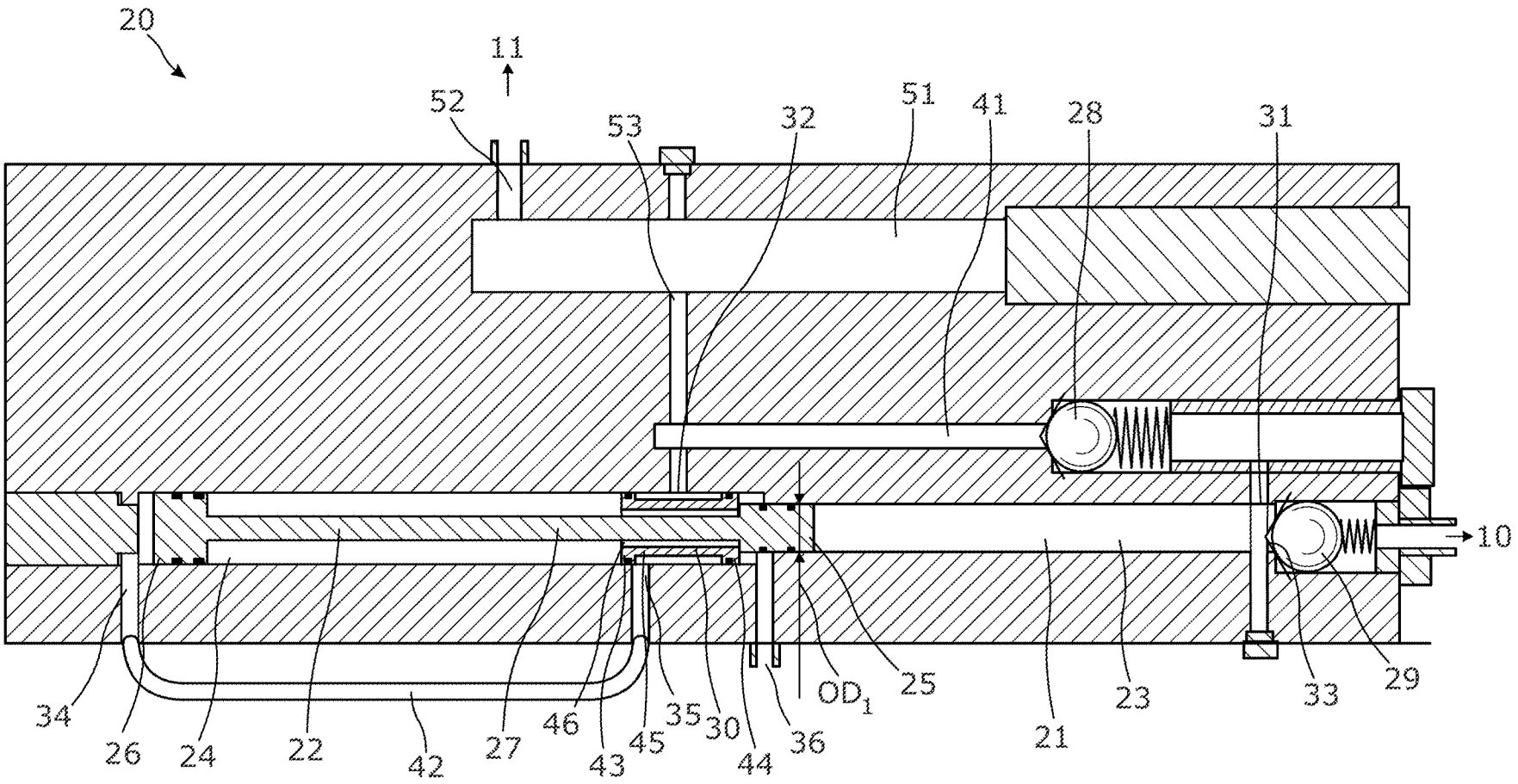
Figure 3:
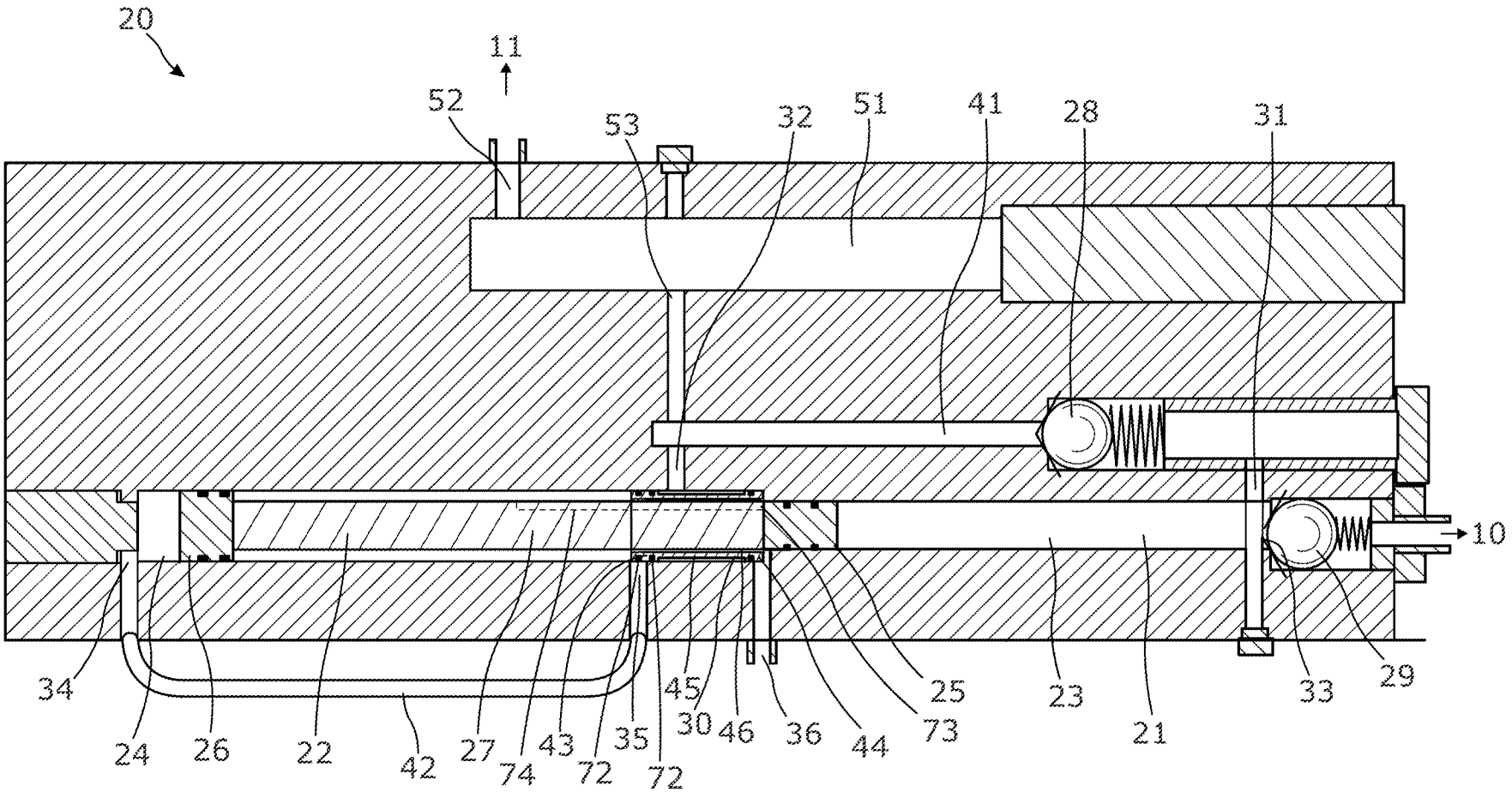
Figure 4A:
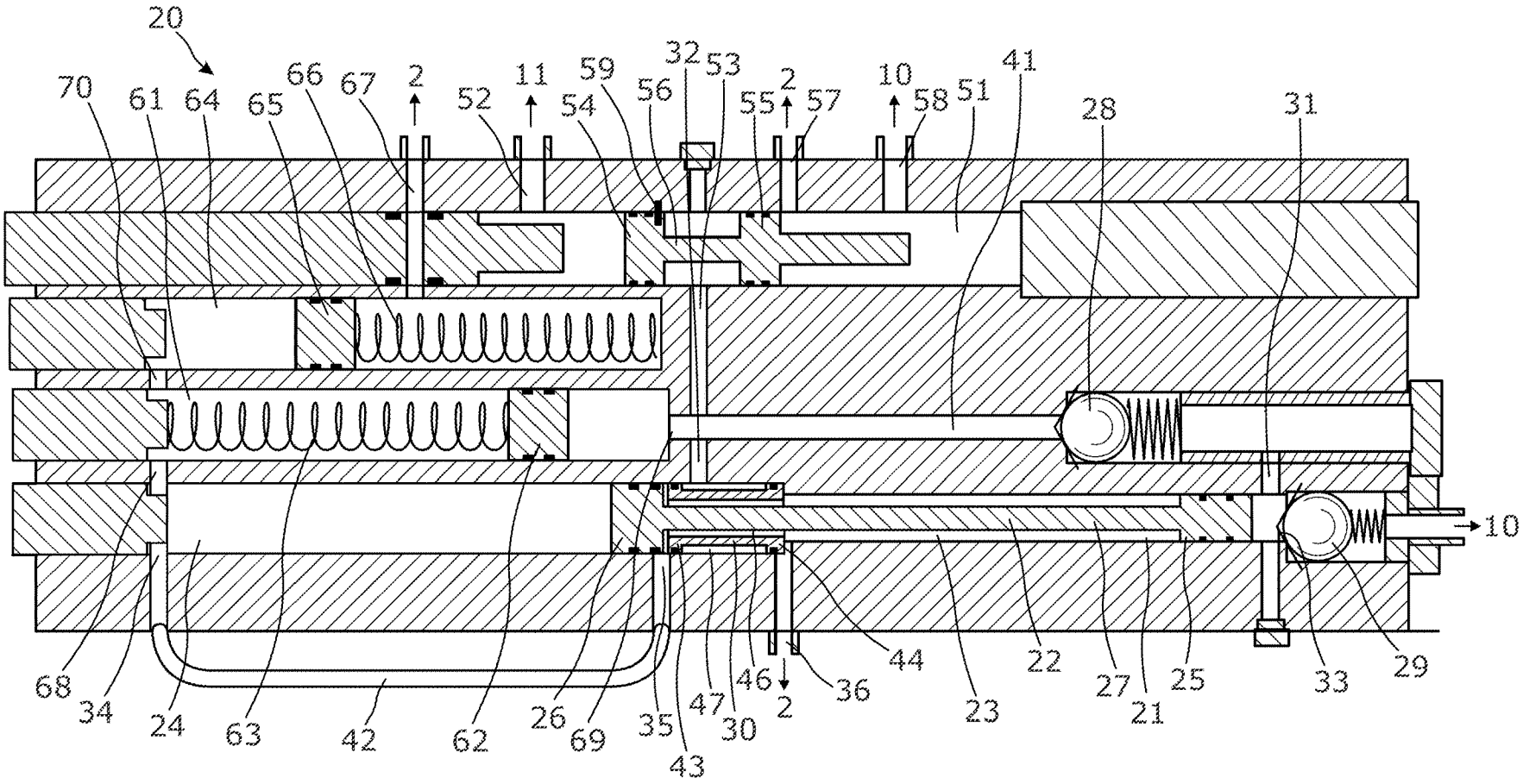
Figure 4B:
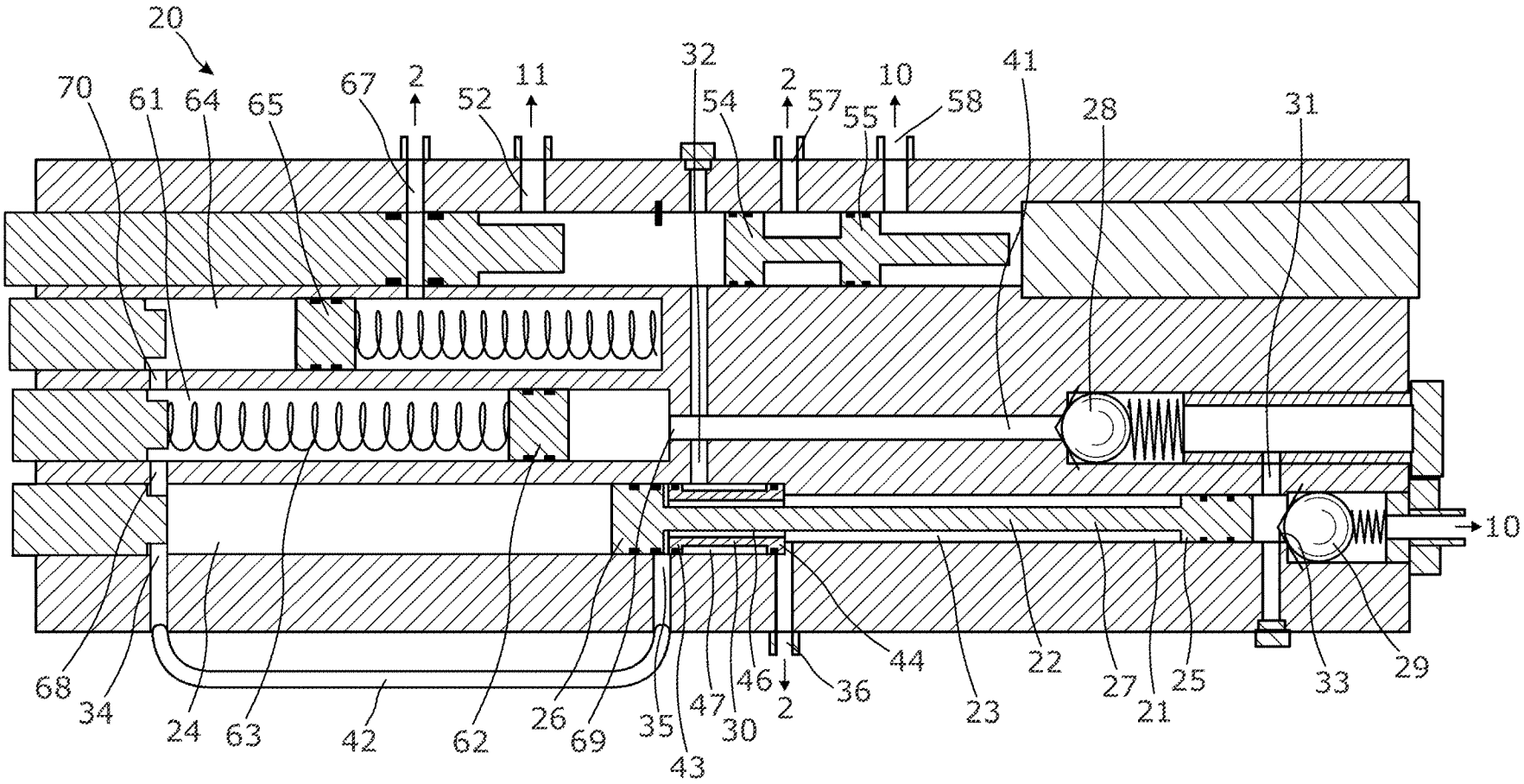
Figure 4C:
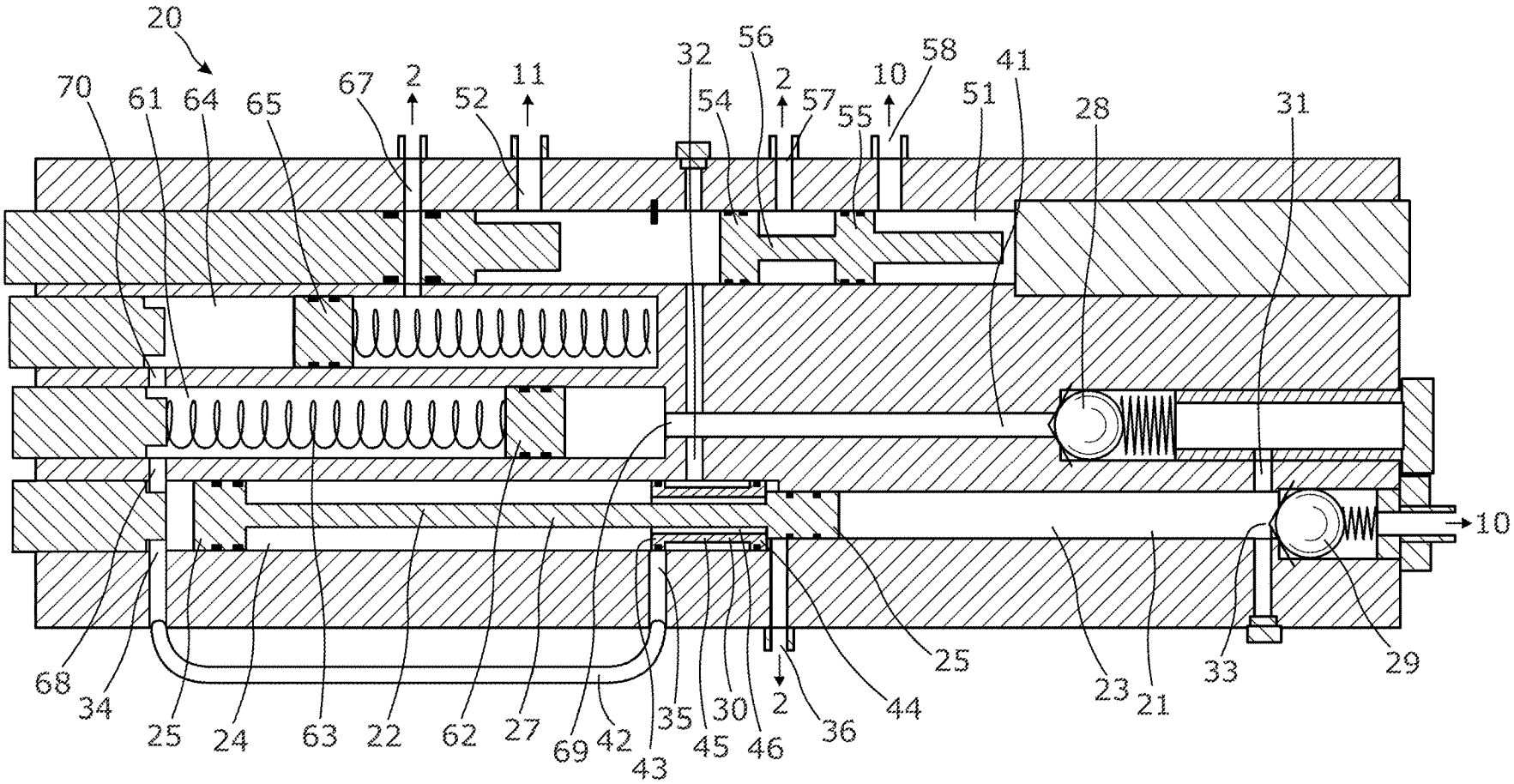
Figure 4D:
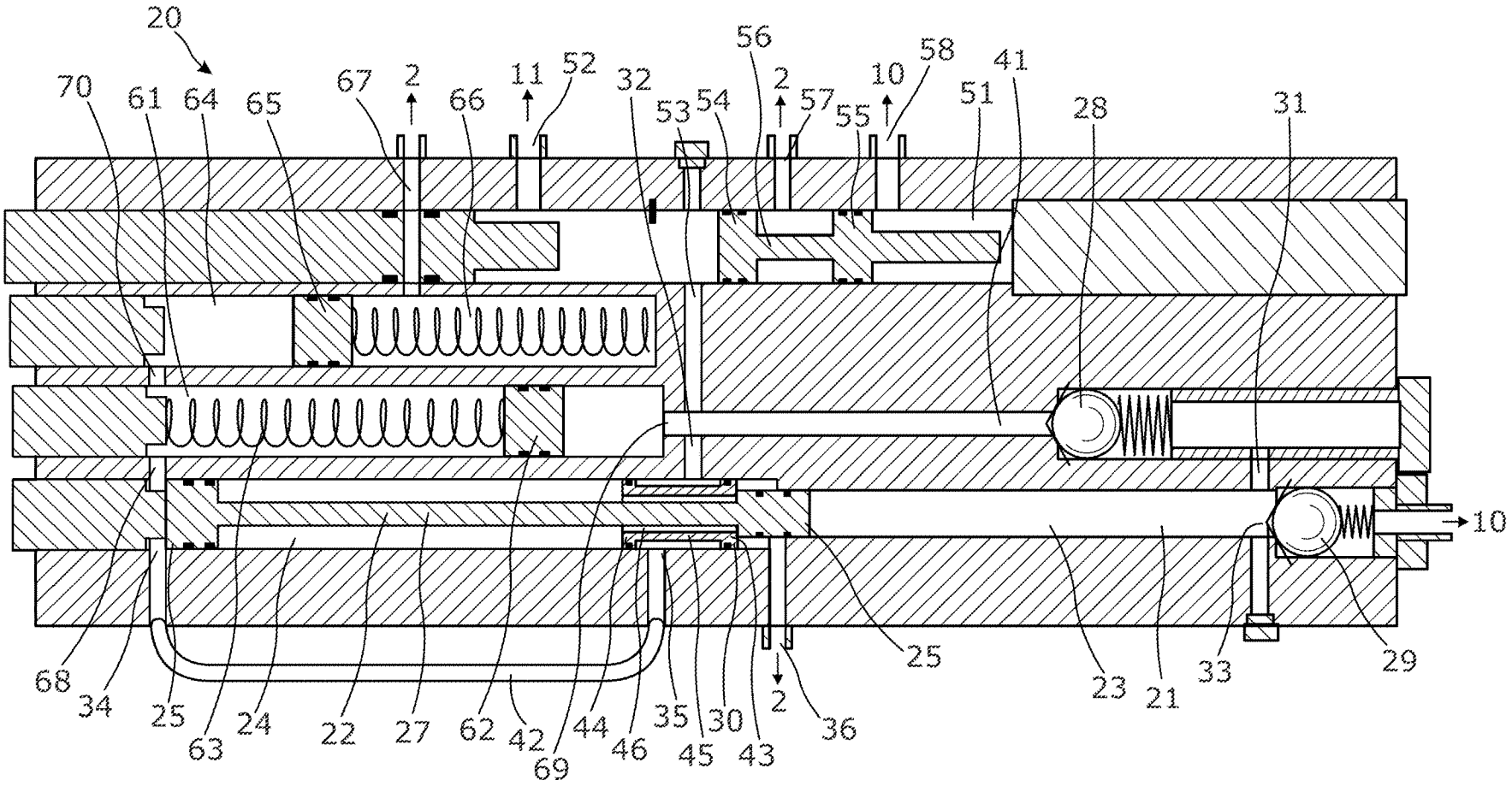
Figure 4E:
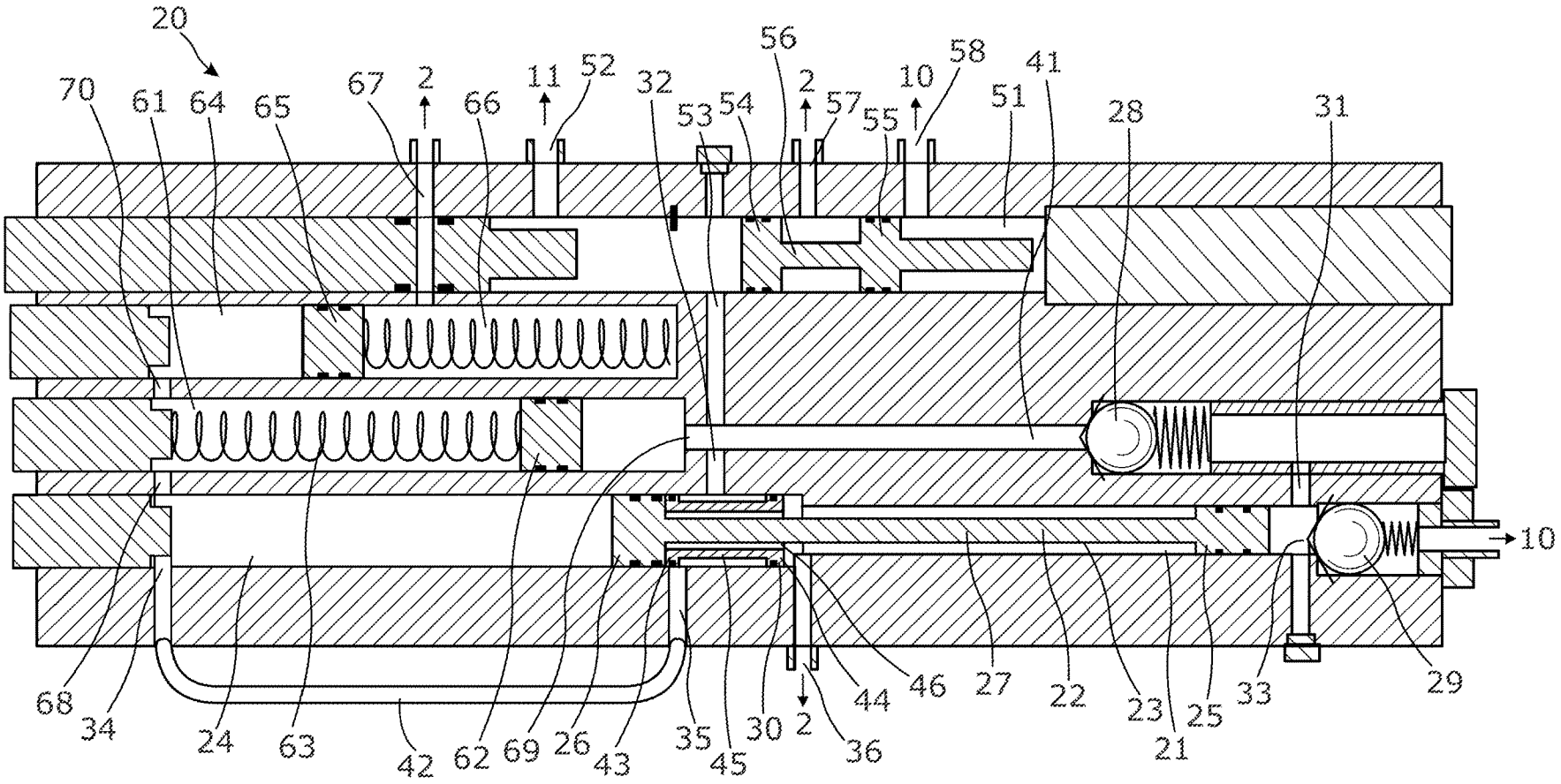
Figure 4F:
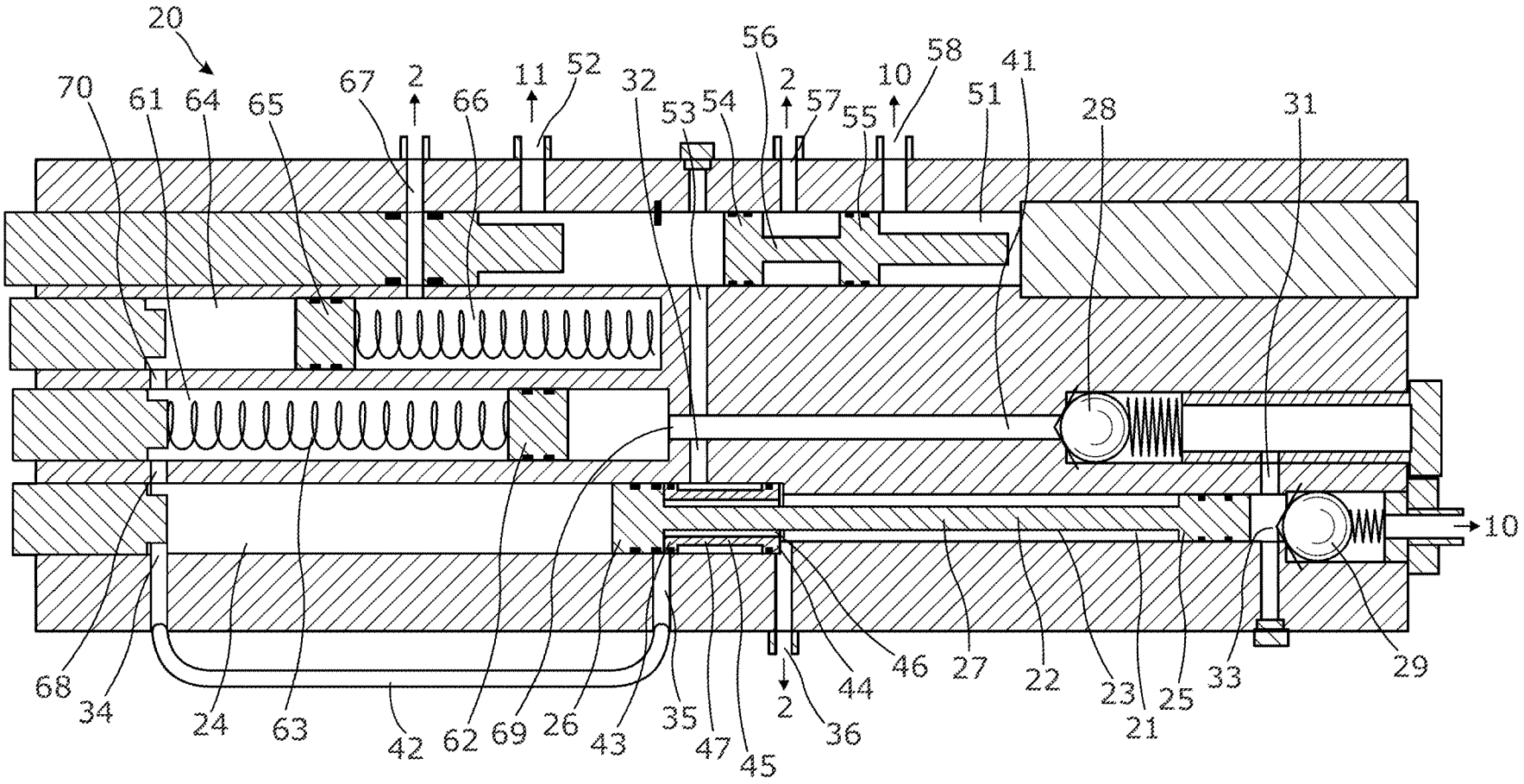
Figure 5A:
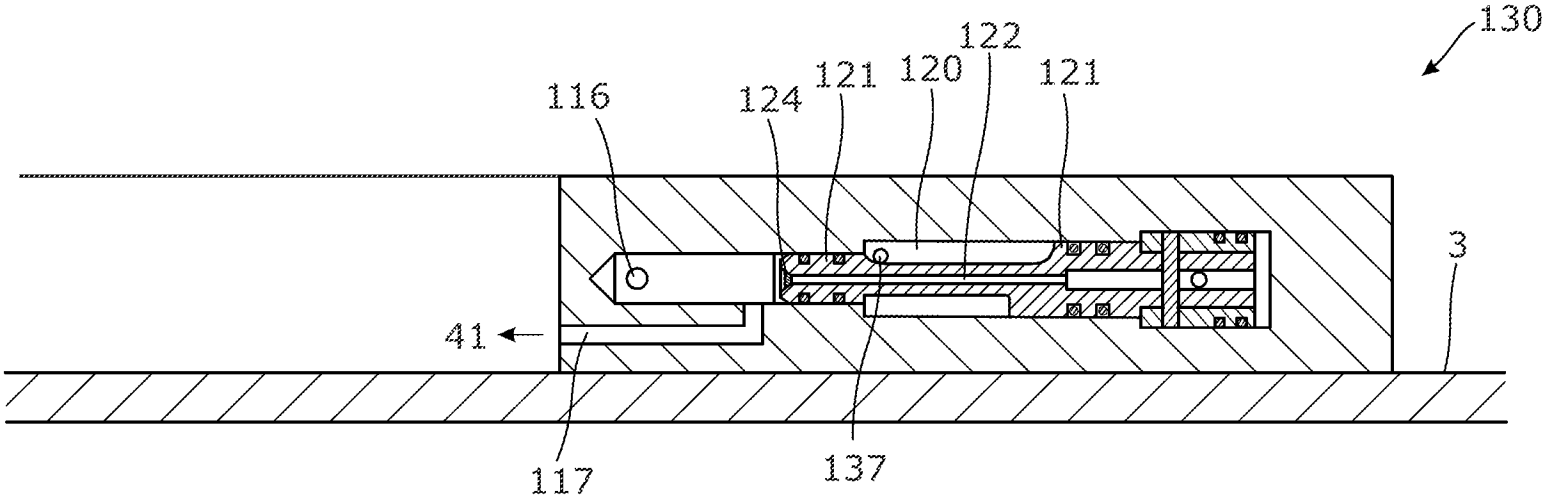
Figure 5B:
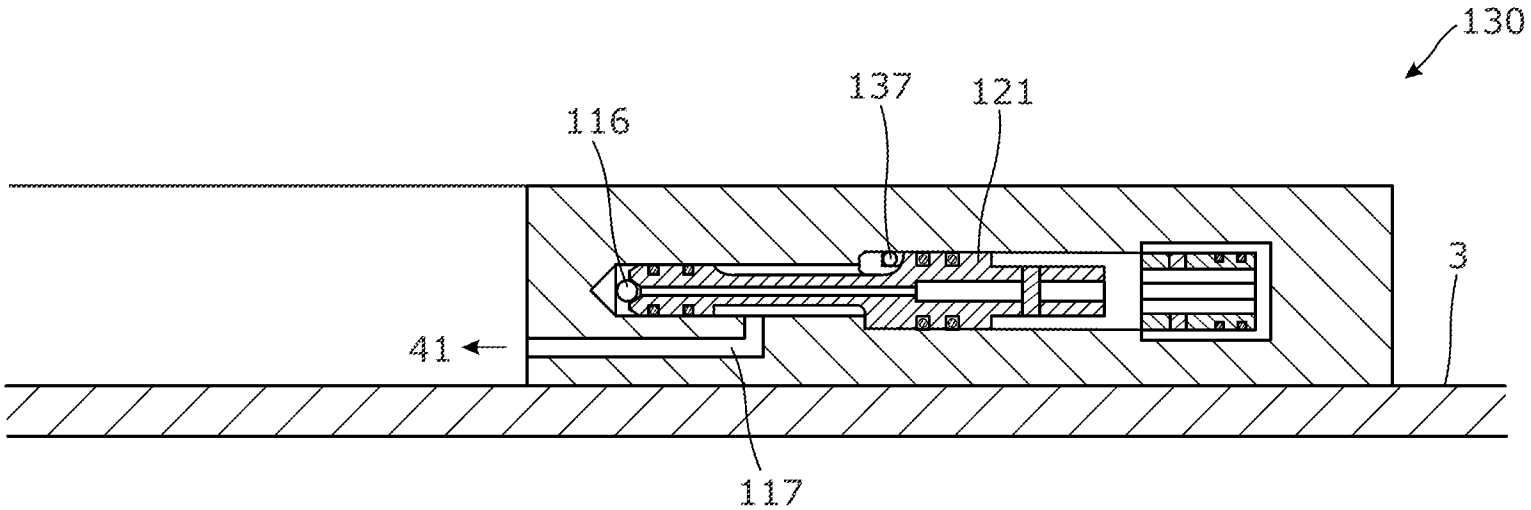
Figure 6:
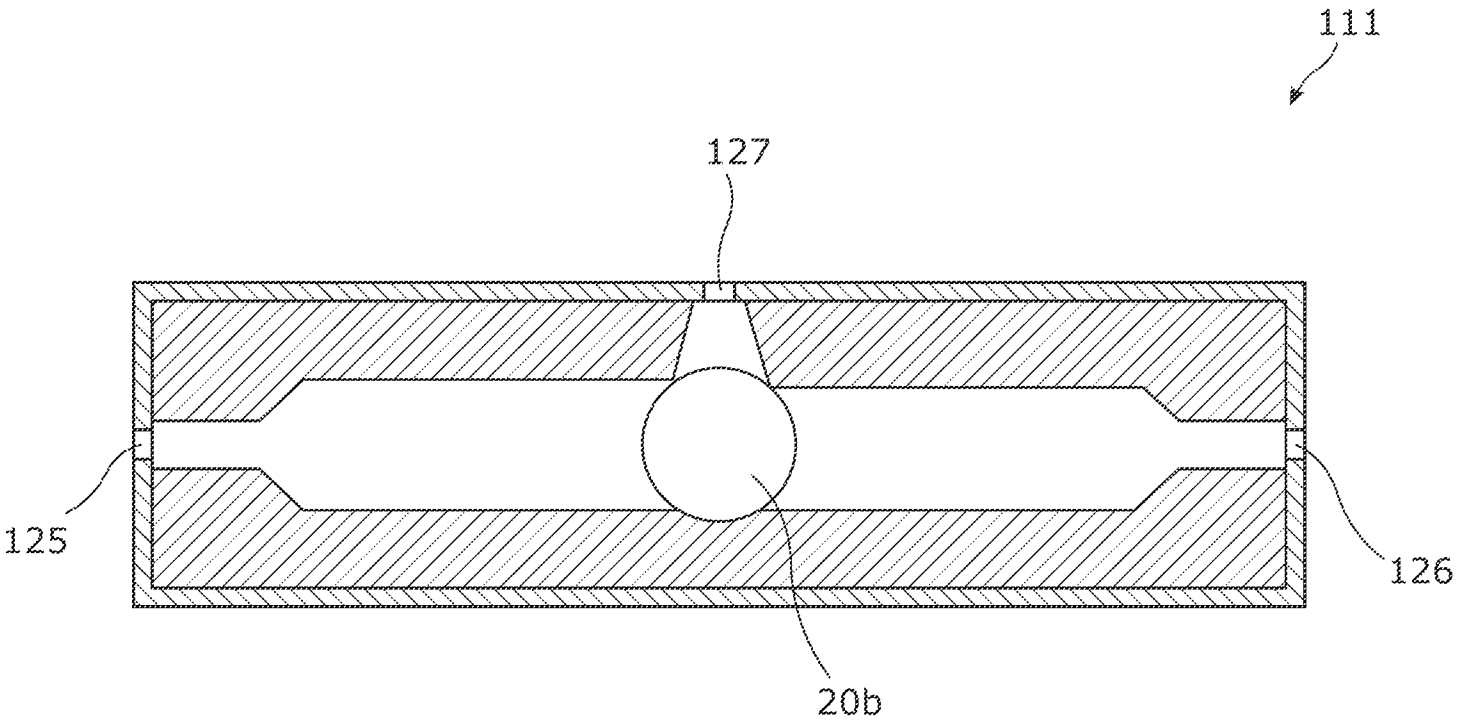

The invention and its many advantages will be described in more detail below with reference to the accompanying schematic drawings, which for the purpose of illustration show some non-limiting embodiments and in which:

FIG. 1 shows a cross-sectional view of an annular barrier according to the invention having a pressure-intensifying unit, FIG. 2A shows a cross-sectional view of a pressure-intensifying unit in one position, FIG. 2B shows a cross-sectional view of a pressure-intensifying unit of FIG. 2A in another position, FIG. 3 shows a cross-sectional view of another pressure-intensifying unit, FIG. 4A shows a cross-sectional view of another pressure-intensifying unit having an accumulating chamber, FIG. 4B shows a cross-sectional view of a pressure-intensifying unit of FIG. 4A in another position, FIG. 4C shows a cross-sectional view of a pressure-intensifying unit of FIG. 4A in yet another position, FIG. 4D shows a cross-sectional view of a pressure-intensifying unit of FIG. 4A in yet another position, FIG. 4E shows a cross-sectional view of a pressure-intensifying unit of FIG. 4A in yet another position, FIG. 4F shows a cross-sectional view of a pressure-intensifying unit of FIG. 4A in yet another position, FIGS. 5A-B show a cross-sectional view of a shear pin assembly in an open and closed position, and FIG. 6 shows a cross-sectional view of a shuttle valve unit.

All the figures are highly schematic and not necessarily to scale, and they show only those parts which are necessary in order to elucidate the invention, other parts being omitted or merely suggested.

FIG. 1 shows an annular barrier 1 which has been expanded in an annulus 2 between a well tubular metal structure 3 and an inside wall 4 of a borehole 5 downhole, providing zone isolation between a first zone 101 and a second zone 102 of the borehole. The annular barrier comprises a tubular metal part 7 which has been mounted as part of the well tubular metal structure inserted into the borehole. The annular barrier comprises an expandable metal sleeve 8 surrounding the tubular metal part, each end 9 of the expandable metal sleeve being connected to the tubular metal part, providing an expandable space 10 between the expandable metal sleeve and the tubular metal part, and the annular barrier comprises an expansion opening 11 in the tubular metal part 7. The annular barrier further comprises a pressure-intensifying unit 20 through which fluid having entered through the expansion opening is pressure-intensified before entering into the expandable space 10 to expand the expandable metal sleeve 8 at a higher pressure than the pressure of the fluid entering the expansion opening in the tubular metal part 7.

In FIG. 2A, the pressure-intensifying unit 20 is shown having a first bore 21 and a piston unit 22. The first bore has a first bore part 23 having a first inner diameter $ID_1$ and a second bore part 24 having a second inner diameter $ID_2$. The piston unit has a first piston 25 having a first outer diameter $OD_1$ corresponding to the first inner diameter and a second piston 26 having a second outer diameter $OD_2$ corresponding to the second inner diameter. The second piston is connected to the first piston by means of a connecting rod 27. The connecting rod 27 has a smaller outer diameter than the second piston. The first outer diameter is smaller than the second outer diameter, as a result of which the fluid having entered through the expansion opening 11 is pressure-intensified before entering the expandable space 10 to expand the expandable metal sleeve 8 of the annular barrier to obtain a higher pressure than the pressure of the fluid entering the expansion opening in the tubular metal part 7 due to the diameter difference between the first piston and the second piston. The first bore part 23 has a first opening 31 in fluid connection with the expansion opening 11 through a first fluid channel 41, and a first non-return valve 28 is arranged in the first fluid channel 41, allowing fluid to enter the first opening. The first bore 21 has a second opening 32 fluidly connected with a part of the first fluid channel upstream of the first non-return valve 28. The first bore part 23 has a third opening 33 in fluid communication with the expandable space 10 through a second non-return valve 29. The second bore part 24 has a fourth opening 34 for entry of fluid in order to allow the first piston 25 to move in a first direction, ejecting fluid through the third opening and into the expandable space, and for exit of fluid in order to allow the first piston 25 to move in a second direction opposite the first direction. The second bore part 24 has a fifth opening 35 in fluid communication with the fourth opening 34 through a second fluid channel 42 for allowing fluid to pass from one side of the second piston 26 to the other side of the second piston when the second piston moves back and forth.

Thus, the first piston 25 moves between the second opening 32 and the third opening 33, and the second piston 26 moves between the fourth opening 34 and the fifth opening 35 so that fluid flows between the fourth opening 34 and the fifth opening via the second fluid channel 42. The second fluid channel functions as a kind of bypass channel so that the second piston 26 is able to move as the fluid is in liquid form downhole and thus more or less incompressible and needs to be displaced elsewhere in order to be able to move the second piston.

The pressure-intensifying unit 20 further comprises a sequence piston 30 surrounding the connecting rod 27. In FIG. 2A, the sequence piston 30 has a first sequence position in which the sequence piston prevents fluid communication between the second opening 32 and the fifth opening 35 so that the fluid from within the tubular metal part 7 passes through the expansion opening 11 and into the first fluid channel 41 through the first non-return valve 28 and in through the first opening 31 and presses onto the first piston 25 to move the first piston in a second direction towards the second bore part 24. In FIG. 2B, the sequence piston has a second sequence position in which the sequence piston allows fluid communication between the second opening and the fifth opening in order to move the piston unit 22 in the first direction and pressing the fluid in the first bore part 23 in through the third opening 33 and the second non-return valve 29 and into the expandable space 10 to expand the expandable metal sleeve 8 of the annular barrier 1. In the second sequence position, the sequence piston 30 straddles the second opening and the fifth opening. In the first sequence position, the sequence piston 30 isolates the second opening so that all fluid through the expansion opening is forced to flow in through the first fluid channel and the first non-return valve and into the first bore part.

As shown in FIG. 2A, the sequence piston 30 has a first piston part 43 and a second piston part 44 and an intermediate piston part 45 connecting the first piston part and the second piston part, and the intermediate piston part has a smaller outer diameter than that of the first piston part and the second piston part so as to fluidly connect the second opening 32 and the fifth opening 35 when the sequence piston 30 is in the second sequence position and so that the first piston part is positioned on one side of the fifth opening 35, and the intermediate piston part straddles the second opening 32 and the fifth opening 35, and the second piston part 44 is arranged on the other side of the second opening 32. Thus, the intermediate piston part has a smaller outer diameter than that of the first piston part 43 and the second piston part 44, providing an annular cavity 47 between the first bore 21 and the sequence piston 30 to enable fluid passage between the second opening and the fifth opening.

The sequence piston 30 has a through-bore 46 having a bore diameter $ID_B$ being larger than the outer diameter of the connecting rod 27 so that fluid is allowed to pass between the connecting rod and the sequence piston along the bore diameter.

The outer diameter of the first piston part 43 and the second piston part 44 of the sequence piston corresponds to the inner diameter of the second bore part 24. However, in another embodiment the sequence piston 30 is arranged in the first bore part 23.

As shown in FIGS. 2A and 2B, the first bore 21 comprises a sixth opening 36 arranged between the fifth opening 35 and the third opening 33 and is in fluid communication with the annulus 2. In that way, the annulus is used as an accumulator. Even though not shown, the sixth opening is in fluid communication with the annulus through a filtering element preventing well fluid particles from entering the pressure-intensifying unit 20 and damaging its function.

In FIG. 3, the first piston part 43 of the sequence piston 30 is provided with at least two sealing elements 72 arranged at a distance between them that is larger than the diameter of the fifth opening 35. In this way, the second piston part of the sequence piston is sealing off the fifth opening until the sequence piston straddles the fifth opening and the second opening, and there is no risk of stranding opposite the fifth opening 35, where fluid may flow from the second opening 32 past the first piston part 43 and directly into the second bore part 24 without being forced through the second fluid channel 42, as shown in FIG. 4C.

As can be seen in FIG. 2A, the outer diameter of the connecting rod 27 is smaller than the first outer diameter and the second outer diameter. In FIG. 3, the outer diameter of the connecting rod is smaller than the first outer diameter and substantially equal to the second outer diameter. In FIG. 3, the sequence piston 30 has an internal key 73 moving in a groove 74 of the connecting rod for bringing the sequence piston to move from the first sequence position to the second sequence position. The movement of the sequence piston from the second sequence position to the first sequence position is performed by the second piston 26.

In order to increase the fluid pressure of the fluid entering the expansion opening 11 before being ejected into the expandable space, the second outer diameter is more than 1.2 times larger than the first outer diameter, preferably more than 1.5 times larger than the first outer diameter, more preferably more than 2 times larger than the first outer diameter, and even more preferably more than 2.5 times larger than the first outer diameter.

The pressure intensification factor of the pressure-intensifying unit 20 is given by the piston area difference between the first and the second piston and thus the difference between the second outer diameter and the first outer diameter $(OD_2/OD_1)^2$.

In FIGS. 4A-4F, the pressure-intensifying unit 20 further comprises a second bore 51 having a first aperture 52 fluidly connected with the expansion opening 11 and a second aperture 53 fluidly connected with the first fluid channel 41. In the second bore, a third piston 54 and a fourth piston 55 connected by means of a second connecting rod 56 are arranged. In a deployment position of the annular barrier 1, i.e. when the annular barrier is run in the hole and mounted as part of the well tubular metal structure 3, the third piston and the fourth piston are arranged on either side of the second aperture 53, preventing fluid from entering the first fluid channel 41 and thus the expandable space 10. In this way, the expandable metal sleeve 8 of the annular barrier 1 is not expanded prematurely, and the annular barrier is not set in an unintended position in the borehole preventing further movement of the well tubular metal structure down the hole. The second bore 51 is arranged in parallel to the first bore 21, but could be arranged in any angle to the first bore.

The third piston 54 and the fourth piston 55 are prevented from moving in the deployment position by a shear pin 59 until the expansion operation starts and a pressure builds up inside the tubular metal part 7; when a predetermined pressure is obtained in the well tubular metal structure 3 acting on the third piston 54, the shear pin is sheared, and the third piston and the fourth piston move, providing fluid communication between the first aperture 52 and the second aperture 53 and fluid communication to the first bore 21. In another embodiment, the shear pin function is arranged in an additional shear pin valve block (shown in FIG. 5) in fluid communication with the second aperture and arranged fluidly between the expansion opening 11 and the second aperture. The shear pin could also be replaced by a shear disc arranged in the fluid communication between the expansion opening and the second aperture.

In order to prevent the expandable metal sleeve 8 from being pressed inwards due to a higher pressure down the well than in the expandable space 10 as the annular barrier 1 is deployed, the second bore 51 further comprises a third aperture 57 in fluid communication with the annulus 2 and a fourth aperture 58 in fluid communication with the expandable space, as shown in FIG. 4A. In the deployment position of FIG. 4A, the third piston 54 and the fourth piston 55 are both arranged on one side of the third aperture 57 and the fourth aperture 58, providing fluid communication between the third and fourth apertures. Thus, the role of the third piston 54 and the fourth piston 55 is also to ensure that there is no trapped pressure in the annular barrier, i.e. in the expandable space 10, during deployment due to the second non-return valve 29. The expandable space 10 underneath the expandable metal sleeve would therefore be pressure-compensated with the annulus pressure. Thus, the third aperture 57 and the fourth aperture 58 are in fluid communication on the "back" side of the third piston 54 and the fourth piston 55 as the second aperture 53 is arranged on the "front" side of the third piston 54 and the fourth piston 55, while the third piston 54 and the fourth piston 55 are arranged on either side of the second aperture.

In FIGS. 4A-4F, the pressure-intensifying unit 20 further comprises a first chamber 61 having a first chamber opening 68 fluidly connected to the second bore part 24 for accumulating fluid from the second bore part. Thus, the first chamber is a kind of accumulating chamber or accumulator. The first chamber has a second chamber opening 69 fluidly connected with the first fluid channel 41, and the first chamber comprises a first chamber piston 62 being spring-loaded by means of a first spring 63 so that the first chamber piston is forced towards the first chamber opening 68. The first chamber piston is allowed to move between the first chamber opening 68 and the second chamber opening 69. By having a first chamber 61 with a spring-loaded first chamber piston 62, the first chamber is able to accumulate fluid in the second bore part 24 which cannot bypass the second piston 26 in the second fluid channel 42 when the second piston 26 moves in the second direction. This is primarily the situation which may occur towards the end of the movement in the second direction as shown in FIG. 4C, where the first piston 25 moves the sequence piston 30, blocking the fifth opening 35 even though the second piston has not moved entirely to the end (as shown in FIG. 4D), and the remaining fluid can then enter the first chamber. In this way, no fluid/liquid is trapped preventing the second piston from moving to the end, and the first piston is not prevented from moving the sequence piston to the second sequence position opening for fluid passage to push the piston unit 22 in the first direction. The first chamber is thus a safety precaution to ensure that the sequence piston is able to move to the second sequence position. The first chamber piston is preloaded by the pressure in the expansion fluid pressing through the second chamber opening 69 and on the first chamber piston.

The pressure-intensifying unit 20 further comprises a second chamber 64 fluidly connected to the second bore part 24 via the first chamber 61. The second chamber comprises a third chamber opening 70 in fluid communication with the first chamber. The second chamber comprises a fourth chamber opening 67 fluidly connected with the annulus 2, and the second chamber comprises a second chamber piston 65 being spring-loaded by means of a second spring 66 so that the second chamber piston is forced towards the fluid connection to the second bore part, i.e. towards the first chamber opening 68, and forced to move between the third chamber opening 70 and the fourth chamber opening 67. By having a second chamber 64 with a spring-loaded second chamber piston 65, the second chamber is able to provide pressurised fluid in the second bore part 24 to press the piston unit fully to the second non-return valve 29 and push the sequence piston 30 to the first sequence position. The second chamber piston 65 experiences annulus pressure from the fourth chamber opening 67 and expansion pressure (pressure from the tubular metal part 7 through the expansion opening 11) through the third chamber opening 70, and when the sequence piston is opposite the fifth opening as shown in FIG. 4E, the fluid may be prevented from entering the second fluid channel 42 and from pressing on the second piston to move the piston unit further towards the second non-return valve. The sequence piston 30 may then not be fully moved to the first sequence position, and then the pressure difference across the second chamber piston will force the second chamber piston to move, increasing the pressure in the second bore part 24 in fluid communication with the second chamber through the first chamber opening.

In this way, the movement of the sequence piston from the position shown in FIG. 4E to the position shown in FIG. 4F is completed, i.e. the first sequence position is ensured so that the movement cycle of the pressure-intensifying unit is completed.

In order to expand the expandable metal sleeve 8 of the annular barrier 1, the piston unit 22 and thus the first piston 25 and the second piston 26 have to move back and forth 500-5000 times, and the seals of these pistons are therefore preferably metal seals, ceramic seals or similar seals able to withstand such load.

FIGS. 5A and 5B disclose a shear element valve block 130 having a first block opening 116 in fluid communication with the expansion opening 11 and a block piston 121 moving in a bore 120 and having a through-bore 122 in which a shear disc 124 is arranged. A second block opening 117 is in fluid communication with the first fluid channel 41 in FIGS. 2A-4F so that, in the first block position shown in FIG. 5A, fluid from the expansion opening is let into the pressure-intensifying unit 20, and in a second block position, as shown in FIG. 5B, the shear element valve block prevents the fluid from entering since the fluid communication between the first block opening 116 and the second block opening 117 is blocked.

The sixth opening 36, the third aperture 57 and the fourth chamber opening 67 may all be fluidly connected with the annulus 2 through a shuttle valve unit 111, e.g. the one shown in FIG. 6, having a first inlet 125 fluidly connected with the first zone 101 of the annulus and a second inlet 126 fluidly connected with the second zone 102 of the annulus, and an outlet 127 fluidly connected to the sixth opening, the third aperture 57 and/or the fourth chamber opening 67. The shuttle valve unit 111 has a movable element 20*b* shuttling from the first valve position where the first inlet is in fluid communication with the outlet and the second valve position where the second inlet is in fluid communication with the outlet. The shuttle valve unit may be any kind of valve unit having these two valve positions.

The annular barrier 1 may be part of a downhole system 100 as shown in FIG. 1, where the downhole system comprises a well tubular metal structure 3 and the above-mentioned annular barrier, and where the tubular metal part 7 is mounted as part of the well tubular metal structure. The downhole system 100 may have a plurality of annular barriers even though not shown.

By fluid or well fluid is meant any kind of fluid that may be present in oil or gas wells downhole, such as natural gas, oil, oil mud, crude oil, water, etc. By gas is meant any kind of gas composition present in a well, completion or open hole, and by oil is meant any kind of oil composition, such as crude oil, an oil-containing fluid, etc. Gas, oil and water fluids may thus all comprise other elements or substances than gas, oil and/or water, respectively.

By a casing or well tubular metal structure is meant any kind of pipe, tubing, tubular, liner, string, etc., used downhole in relation to oil or natural gas production.

Although the invention has been described above in connection with preferred embodiments of the invention, it will be evident to a person skilled in the art that several modifications are conceivable without departing from the invention as defined by the following claims.

The invention claimed is:

1. An annular barrier to be expanded in an annulus between a well tubular metal structure and an inside wall of a borehole downhole for providing zone isolation between a first zone and a second zone of the borehole, comprising a tubular metal part for mounting as part of the well tubular metal structure, an expandable metal sleeve surrounding the tubular metal part, each end of the expandable metal sleeve being connected with the tubular metal part, an expandable space between the expandable metal sleeve and the tubular metal part, and an expansion opening in the tubular metal part through which fluid enters in order to expand the expandable metal sleeve, wherein the annular barrier further comprises a pressure-intensifying unit having a first bore and a piston unit, the first bore having a first bore part with a first inner diameter and a second bore part with a second inner diameter, the piston unit having a first piston with a first outer diameter corresponding to the first inner diameter and a second piston with a second outer diameter corresponding to the second inner diameter, and the second piston being connected to the first piston by means of a connecting rod, which connecting rod has a smaller outer diameter than the second piston, the first outer diameter being smaller than the second outer diameter, the first bore part having a first opening in fluid communication with the expansion opening through a first fluid channel, a first non-return valve being arranged in the first fluid channel allowing fluid to enter the first opening, the first bore having a second opening fluidly connected with a part of the first fluid channel upstream of the first non-return valve, the first bore part having a third opening in fluid communication with the expandable space through a second non-return valve, the second bore part having a fourth opening for entry of fluid in order to allow the first piston to move in a first direction, ejecting fluid through the third opening and into the expandable space, and for exit of fluid in order to allow the first piston to move in a second direction opposite the first direction, and wherein the second bore part has a fifth opening in fluid communication with the fourth opening through a second fluid channel, and a sequence piston surrounding the connecting rod and having a first sequence position in which the sequence piston prevents fluid communication between the second opening and the fifth opening and a second sequence position in which the sequence piston allows fluid communication between the second opening and the fifth opening in order to move the piston unit in the first direction.

2. An annular barrier according to claim 1, wherein the first bore comprises a sixth opening arranged between the fifth opening and the third opening and in fluid communication with the annulus.

3. An annular barrier according to claim 1, wherein the second piston moves between the fourth opening and the fifth opening so that fluid flows between the fourth opening and the fifth opening via the second fluid channel.

4. An annular barrier according to claim 1, wherein the sequence piston has a first piston part and a second piston part and an intermediate piston part connecting the first piston part and the second piston part, the intermediate piston part having a smaller outer diameter than that of the first piston part and the second piston part so as to fluidly connect the second opening and the fifth opening when the sequence piston is in the second sequence position.

5. An annular barrier according to claim 4, wherein the sequence piston has a through-bore having a bore diameter being larger than the outer diameter of the connecting rod so that fluid is allowed to pass between the connecting rod and the sequence piston.

6. An annular barrier according to claim 4, wherein the second piston part of the sequence piston is provided with at least two sealing elements arranged at a distance between them that is larger than the diameter of the fifth opening.

7. An annular barrier according to claim 1, wherein the sequence piston has a first piston part and a second piston part and an intermediate piston part connecting the first piston part and the second piston part, the intermediate piston part having a smaller outer diameter than that of the first piston part and the second piston part, providing an annular cavity between the first bore and the sequence piston to enable fluid passage.

8. An annular barrier according to claim 1, wherein the second outer diameter is more than 1.5 times larger than the first outer diameter, preferably more than 2 times larger than the first outer diameter, and more preferably more than 2.5 times larger than the first outer diameter.

9. An annular barrier according to claim 1, wherein the pressure-intensifying unit further comprises a second bore having a first aperture fluidly connected with the expansion opening and a second aperture fluidly connected to the first fluid channel, a third piston and a fourth piston connected by means of a second connecting rod being arranged in the second bore, and in a deployment position, the third piston and the fourth piston being arranged on either side of the second aperture, preventing fluid from entering the expandable space.

10. An annular barrier according to claim 9, wherein, in the deployment position, the third piston and the fourth piston are both arranged on one side of the third and fourth apertures, providing fluid communication between the third and fourth apertures.

11. An annular barrier according to claim 1, wherein the pressure-intensifying unit further comprises a first chamber having a first chamber opening fluidly connected to the second bore part for accumulating fluid from the second bore part.

12. An annular barrier according to claim 11, wherein the first chamber has a second chamber opening fluidly connected with the first fluid channel, and the first chamber comprises a first chamber piston being spring-loaded by means of a first spring so that the first chamber piston is forced towards the first chamber opening, the first chamber piston being allowed to move between the first chamber opening and the second chamber opening.

13. An annular barrier according to claim 11, wherein the pressure-intensifying unit further comprises a second chamber fluidly connected with the second bore part via the first chamber.

14. An annular barrier according to claim 13, wherein the second chamber comprises a third chamber opening in fluid communication with the first chamber, the second chamber comprising a fourth chamber opening fluidly connected with the annulus, the second chamber comprising a second chamber piston being spring-loaded by means of a second spring so that the second chamber piston is forced towards the fluid connection to the second bore part and forced to move between the third chamber opening and the fourth chamber opening.

15. Downhole system comprising a well tubular metal structure and an annular barrier according to claim 1, wherein the tubular metal part is mounted as part of the well tubular metal structure.

* * * * *